US006286600B1

(12) United States Patent
Hall et al.

(10) Patent No.: US 6,286,600 B1
(45) Date of Patent: Sep. 11, 2001

(54) PORTED SUB TREATMENT SYSTEM

(75) Inventors: Scott D. Hall, Littleton; Cal Crawley, Elbert, both of CO (US); Danny F. Sullivan, Midland, TX (US); Patrick D. Ellis, Littleton; Glen M. Kniffin, Parker, both of CO (US)

(73) Assignee: Texaco Inc., White Plains, NY (US)

( * ) Notice: Subject to any disclaimer, the term of this patent is extended or adjusted under 35 U.S.C. 154(b) by 0 days.

(21) Appl. No.: 09/228,667

(22) Filed: Jan. 12, 1999

Related U.S. Application Data

(60) Provisional application No. 60/071,004, filed on Jan. 13, 1998.

(51) Int. Cl.[7] ..... E21B 43/00

(52) U.S. Cl. ..... 166/305.1; 166/307; 166/308; 166/313

(58) Field of Search ..... 166/279, 269, 166/305.1, 306, 307, 308, 313, 271

(56) References Cited

U.S. PATENT DOCUMENTS 4,951,751 * 8/1990 Jennings, Jr. .
5,117,912 * 6/1992 Young .
5,363,919 * 11/1994 Jennings, Jr. .
5,743,334 * 4/1998 Nelson .
5,765,642 * 6/1998 Surjaatmadja .
5,899,274 * 5/1999 Frauenfeld et al. .

OTHER PUBLICATIONS

J.A. Short, Introduction to Directional and Horizontal Drilling, 1993, pp. 214–221.

* cited by examiner

*Primary Examiner*—H. Shackelford
(74) *Attorney, Agent, or Firm*—Morris N. Reinisch; Howrey Simon Arnold & White

(57) ABSTRACT

A ported sub treatment system in which well treatment materials are pumped into an uncased portion of a well through a jointed tubing string having a number of holes at specific locations along its length such that these materials are able to be distributed as desired by the operator, through these holes, along the length of the well. The treatment system is also able to provide sufficient pressure such that treatment materials are able to penetrate or fracture the rock surrounding the well, if necessary.

20 Claims, 2 Drawing Sheets

PORTED SUB TREATMENT SYSTEM

This application claims priority from Provisional Patent Application No. 60/071,004, filed on Jan. 13, 1998.

BACKGROUND OF THE INVENTION

Commonly, in the oil industry, it is necessary to treat wells with materials such as stimulation fluids. In certain stimulation processes, it is necessary for the fluids to be under enough pressure that they penetrate the rock surrounding the well, and that the fluids be dispersed at specific locations desired by the operator along the length of the well. This becomes especially necessary with horizontal wells which can have very long uncased portions requiring stimulation.

Traditionally, in the oil industry, two methods have been used to distribute treatment or stimulation materials into an uncased well. One method is the "bullhead" treatment method in which a jointed tubing is run to the bottom of the vertical or cased section of the well, and stimulation materials are pumped through the tubing, out of its bottom end, into the uncased portion of the well. This method has been successful in creating high enough pressures such that rock penetration, or "matrix acidizing" can be achieved, or the rock may be parted in a fracture treatment. However, studies have shown that this method offers very poor distribution of stimulation materials throughout the well, and does not allow the operator to determine where in the formation the stimulation materials are distributed.

Another method that has been used is the coiled tubing method, wherein a thin coiled tubing is run down the length of the well as stimulation materials are pumped through the coiled tubing. This method offers very good distribution of stimulation materials, however the coiled tubing method does not provide enough pressure such that the stimulation materials are able to adequately penetrate the matrix of, or fracture, the rock surrounding the well.

Another well stimulation system popular in the early 1980's was the "limited entry" system. This method was used exclusively with vertical, cased wells and involved perforating the casing at specific locations in the well. After a vertical well was completed with casing cemented in place, the casing was perforated in specific locations along its length and stimulation materials were pumped into the well. Thus, an operator could stimulate specific perforated portions of the vertical cased well. This method, however, did not allow any variance of the locations to be treated at a later time. The casing perforations were permanently in place, and if further locations were desired to be treated, the original perforations could not be removed without losing the pathway to the original treatment. The stimulated areas could only be added, and not varied. Thus, repeated stimulation of the same cased, vertical well in different locations resulted in a reduction of the desired distribution.

In uncased wells, the limited entry method is not available, especially when the uncased portion of the well is deviated. According to J. A. Short, author of *Introduction to Directional and Horizontal Drilling*, p. 215 (1993), fracturing and acidizing stimulation techniques are uncommon in horizontal open hole completions because "it is difficult to determine the amount and location where treating fluid enters the formation." Thus, for the foregoing reasons, there is a need for an improved stimulation method for use with deviated, uncased wells, providing the operator with a sufficient ability to distribute stimulation materials at particular locations in the formation while also providing adequate pressure such that stimulation materials can penetrate the matrix of or fracture, the rock if necessary.

SUMMARY OF THE INVENTION

The present invention is directed to a process for providing stimulation or other materials, such as acidizing fluid, to the uncased portion of a well while providing a specifically desired distribution of the material along the well's length, as well as adequate pressure such that the stimulation materials can penetrate the matrix of, or even fracture, the rock if necessary. The specific distribution locations may then be easily varied and/or used with other wells. One exemplary method involves taking a normal jointed tubing string and inserting ported subs, which are portions of tubing with holes along their length, at calculated intervals along the tubing string's length, depending on what area of the formation is desired to be treated. These ported subs may be joints of typical production tubing, or other specially manufactured joints of tubing, which have openings along their length sufficient to release stimulation materials. Because production tubing may be used, stimulation materials may be pumped into the well at a sufficient pressure such that the rock can be penetrated. Also, the distribution of holes along the tubing's length provides an opportunity for the stimulation materials to be deposited into the well at calculated points along its length. This provides a specifically desired distribution of stimulation materials along the length of the well. The tubing can then be removed and the location of the ported subs changed such that a different desired distribution can be achieved with the same or different well.

It is preferred that in this method the bottom end of the jointed tubing string be plugged for maximum effectiveness. Also, if the well to be treated is one with a number of laterals originating from the same primary drilling hole, an inflatable packer can be placed at the top of the lateral being treated, after its kick off point from the central bore hole, such that the stimulation materials do not overflow into other laterals, and such that pressure is maintained in the lateral being treated.

DESCRIPTION OF ILLUSTRATIVE EMBODIMENTS

Figure 1:
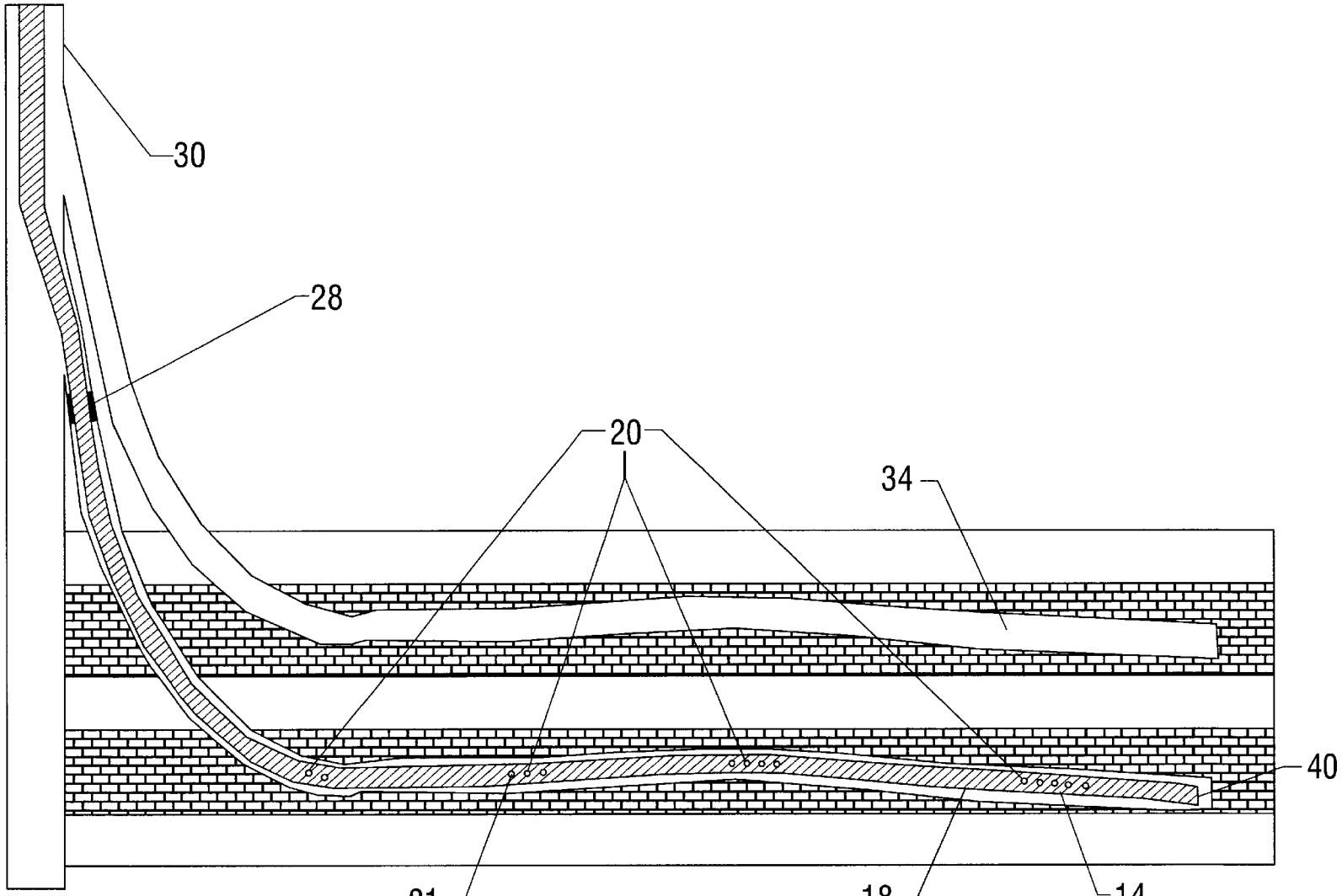
FIG. 1 is a cross sectional view of an illustrative embodiment of a ported sub treatment system.

As shown in FIG. 1, one exemplary embodiment of this invention comprises a length of tubing, or jointed tubing string, 18 having a plurality of holes 20 placed at specific intervals along its length. These holes 20 are of an effective size to release well treatment or stimulation materials, when such materials are pumped into the tubing. This jointed tubing string can be any type of tubing, preferably a type which is normally used in bullhead stimulation operations or conventional production tubing and may be of a type which can withstand high pressures. The material that this tubing string is constructed of can be varied depending on what types of materials are being pumped into the well. It should be known by one of ordinary skill in the art what types of tubing can withstand the pressures of and be used with different types of well treatments, such as washing, fracturing, and acidizing.

The holes along the length of the tubing string can be provided by inserting ported subs 14, preferably jointed ported subs, containing one or more holes 20 along their length, at points along the jointed tubing string 18. Ported subs are normal or specially manufactured joints of tubing which have openings along their length sufficient to release stimulation materials. The ported subs are preferably constructed of the same material as the jointed tubing, however, any kind of normal carbon steel tubing or other similar tubing should work sufficiently. The size of holes 20 will depend on the viscosity of the materials meant to be distributed throughout the well and can be determined by one of ordinary skill in the art by trial and error. The hole size can also be varied depending on the desired volume of materials to be pumped into the well. Hole size, however, preferably ranges from about 0.125 inches to about 1 inch in diameter.

Figure 2:
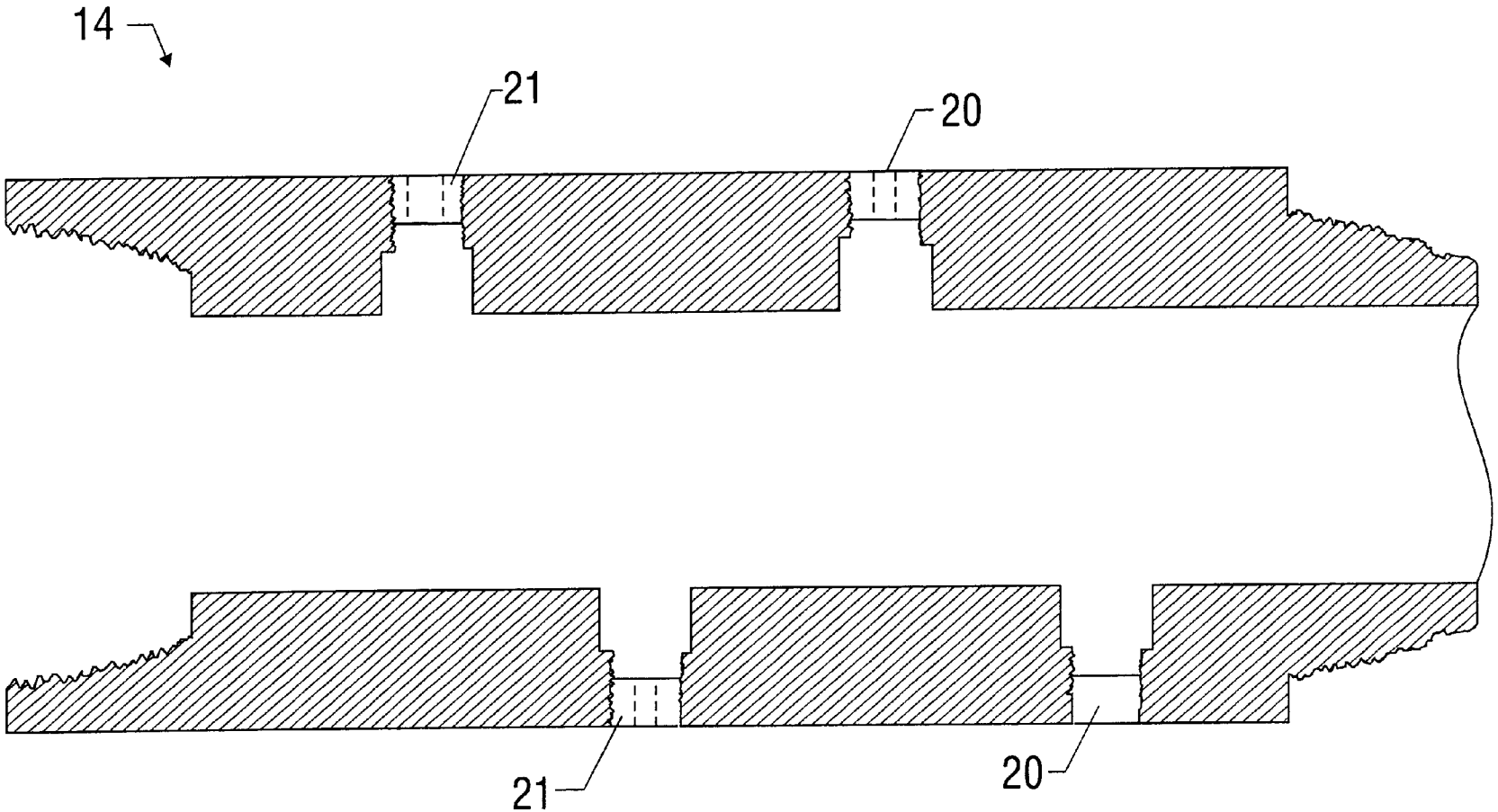
FIG. 2 is a cross-sectional view of a ported sub having holes and nozzles of variable sizes.

In another illustrative embodiment of this invention, as shown in FIG. 2 holes 20 are surrounded by nozzles 21 which are replaceable, i.e., the nozzles can be removed and nozzles of other sizes and materials attached in their place. In this way, the hole size in a ported sub can be predetermined and varied for use with different types of well treatment fluids. Nozzles 21 may preferably be made of a non-erosional (non-corrosive) material such as tungsten carbide or any other material which resists being destroyed by well treatment materials which can be utilized with this system. Different sizes of nozzles 21 may also be utilized in the same or different ported subs 14 during each well treatment such that pressure and/or distribution of well treatment fluids can be varied throughout different sections of the uncased portion of the well being treated.

The bottom end of the jointed tubing string 18 may be plugged (such as with plug 40) such that no treatment materials can travel through the open end of the tubing string. Therefore, all materials must be released from the tubing string through holes 20 along the length of the tubing string.

An embodiment of the invention can also be used when the well being treated is one of a plurality of lateral wells, or "laterals." A "lateral" is one of several deviated or horizontal wells originating from the same central well. This is shown in FIG. 1. In this situation, an inflatable or other type of packer 28 may be utilized to prevent spillage of treatment materials into the other laterals 34, as shown in FIG. 1. The packer 28 can be placed at the top of the lateral being treated, at a distance below the location at which the lateral deviates from the central well 30. This location is known as the "kick off point."

In another illustrative embodiment, ported subs 14 containing a plurality of holes 20, are placed at various points along the length of a jointed tubing string. The specific placement of ported subs 14 may depend on the length of the uncased portion of the well sought to be treated as well as the particular distribution of treatment materials desired by the operator. One of ordinary skill in the art should be able to calculate the specific location of the ported subs resulting in the desired distribution of materials.

Ported subs 14 are preferably jointed so that they may be easily connected at selected points along the tubing string. The number and location of ported subs 14 placed along joint tubing string 18 may affect both the distribution and pressure at which the materials are distributed into the well. Thus, the more ported subs or holes used will increase the distribution area. These factors, along with the size of the holes 20 and nozzles 21 in ported subs 14 should give a skilled operator the ability to easily achieve the desired distribution of treatment materials in the well. Also, the number of holes 20 used and their placement along the tubing string 18 will vary depending on the particular well, field, and formation, as well as other factors unique to the particular well being treated. One of ordinary skill in the art may vary these factors to achieve the most effective treatment system for the particular well.

In an embodiment of the claimed method, the tubing string 18, with ported subs 14, is inserted into the uncased well's production zone as far as desired. The "production zone" of the well is the area in which oil and/or gas enters the well. This area can be deviated or horizontal, relative to the earth's surface, as shown in FIG. 1. In horizontal operations, the production zone can often be several hundred or thousands of feet long.

Materials, such as acidizing stimulants, proppent materials, or other well treatment materials, are then pumped or otherwise inserted into the tubing at the desired rate and pressure. These materials then exit the tubing at specific points in the wells' length out of the holes 20 in the ported subs 14. This results in improved distribution of the materials at the rate and pressure desired by the operator. Rates and pressures can be varied based on whether the operator desires to wash the sides of the well, merely penetrate the matrix of the rock, or cause fracturing of the rock itself. The tubing string 18 can then be removed from the well and the location of ported subs 14 varied for use in treating another well. Although this method is preferably used with horizontal wells, it can also be used with uncased portions of vertical or deviated wells.

If the well being treated is one of several laterals originating from a central well 30, the operator can prevent spillage of treatment materials into other laterals 34 by placing an inflatable packer 28, known to those of ordinary skill in the art, at a point in the lateral being treated after its kick off point from the central well. Therefore, desired distribution and high pressures are maintained while preventing stimulation materials from overflowing into other laterals.

This invention therefore allows an operator to treat the uncased portions of horizontal, vertical, or deviated wells at a pressure sufficient to penetrate the matrix of, or fracture, the rock if necessary. However, it also allows the operator greater control over the distribution of stimulation materials along the length of the well, and at higher rates and pressures, than previous treatment systems have allowed.

What is claimed is:

1. A method of providing materials to an uncased portion of a well comprising:

inserting an effective length of tubing into said uncased well, wherein said length of tubing has one or more holes located at multiple predetermined locations along the tubing's length, each location laterally spaced from the other and defined by a set of holes, and said tubing is not cemented into said well; and providing well treatment materials into said tubing such that said materials are released from said openings into predetermined locations within an uncased area of said well such that separate locations in said well proximate to each set of holes may be treated by the same well treatment materials in a single stage.

2. The method of claim 1 in which the uncased area of said well deviates from a direction perpendicular to the earth's surface.

3. The method of claim 1 wherein said length of tubing is jointed.

4. The method of claim 3 wherein said length of tubing further comprises one or more ported subs placed at specific locations along said length of tubing, said ported subs comprising lengths of jointed tubing having one or more holes located along their length such that well treatment materials can be released from said holes.

5. The method of claim 4 wherein said holes are surrounded by replaceable nozzles.

6. The method of claim 5 wherein said nozzles can be varied in size.

7. The method of claim 6 wherein said nozzles are non-erosional.

8. The method of claim 1 wherein said length of tubing is plugged at the bottom end of said length of tubing.

9. The method of claim 1 further comprising setting a packer at a location in said well such that said well treatment materials are effectively blocked from moving past said packer.

10. The method of claim 9 wherein said well is one of a plurality of lateral wells originating from a central bore hole and said packer is set at a location deeper than the kick-off point of said well.

11. The method of claim 1 further comprising leaving said tubing uncemented in said well after treatment.

12. A well treatment device comprising: a length of tubing having two ends and one or more holes located at multiple predetermined locations along the tubing's length, each location laterally spaced from the other and defined by a set of holes, such that well treatment materials can be released from said holes into an uncased portion of a well such that separate locations in said well proximate to each set of holes may be treated by the same well treatment materials in a single stage, said tubing not being cemented into said well, said device able to be reused on the same or different wells.

13. The well treatment device of claim 12 wherein said length of tubing is jointed.

14. The well treatment device of claim 13 wherein said length of tubing further comprises one or more ported subs placed at specific locations along said length of tubing, said ported subs comprising lengths of jointed tubing having one or more holes located along their length such that well treatment materials can be released from said holes.

15. The well treatment device of claim 14 wherein said holes are defined by replaceable nozzles.

16. The well treatment device of claim 15 wherein said nozzles can be varied in size.

17. The well treatment device of claim 16 wherein said nozzles are non-erosional.

18. The well treatment device of claim 14 wherein said ported subs can be removed from said locations along said length of tubing and replaced in different locations.

19. The well treatment device of claim 12 wherein said length of tubing is plugged at the bottom end of said length of tubing.

20. A well treatment system comprising:

a length of tubing having two ends, and one or more openings at multiple predetermined locations along its length, each location laterally spaced from the other and defined by a set of holes, such that well treatment materials, when pumped into said tubing after said tubing has been inserted into an uncased portion of a well, are released from said openings at predetermined locations in the uncased portion of said well such that separate locations in said well proximate to each set of holes may be treated by the same well treatment materials in a single stage.

* * * * *